US007053920B1

(12) United States Patent
Naugler, Jr. et al.

(10) Patent No.: US 7,053,920 B1
(45) Date of Patent: May 30, 2006

(54) FEEDBACK CONTROL APPARATUS AND METHOD FOR AN EMISSIVE PRINTHEAD

(75) Inventors: W. Edward Naugler, Jr., Cedar Park, TX (US); Damoder Reddy, Los Gatos, CA (US)

(73) Assignee: Nuelight Corporation, Santa Clara, CA (US)

( * ) Notice: Subject to any disclaimer, the term of this patent is extended or adjusted under 35 U.S.C. 154(b) by 0 days.

(21) Appl. No.: 11/133,127

(22) Filed: May 18, 2005

Related U.S. Application Data

(60) Provisional application No. 60/660,725, filed on Mar. 11, 2005.

(51) Int. Cl.
*B41J 2/435* (2006.01)

(52) U.S. Cl. ..... 347/236; 347/246

(58) Field of Classification Search ..... 347/236–238, 347/241, 246–247, 253, 133; 327/514; 353/31; 250/205, 208.2; 315/169.3

See application file for complete search history.

(56) References Cited

U.S. PATENT DOCUMENTS

| | | | | |
|---|---|---|---|---|
| 5,235,175 | A * | 8/1993 | Mayer | 250/208.2 |
| 5,815,025 | A * | 9/1998 | Kubota | 327/514 |
| 5,859,658 | A * | 1/1999 | Hammond | 347/238 |
| 6,034,710 | A * | 3/2000 | Kawabe et al. | 347/236 |
| 6,078,347 | A * | 6/2000 | Nukui | 347/246 |
| 6,330,020 | B1 * | 12/2001 | Kamioka | 347/241 |
| 6,753,897 | B1 * | 6/2004 | Vazan | 347/237 |
| 6,828,538 | B1 * | 12/2004 | Maeda | 250/205 |
| 6,869,185 | B1 * | 3/2005 | Kaminsky et al. | 353/31 |
| 2004/0183457 | A1 * | 9/2004 | Kondo et al. | 315/169.3 |
| 2005/0088380 | A1 | 4/2005 | Bulovic et al. | 345/77 |

FOREIGN PATENT DOCUMENTS

| | | |
|---|---|---|
| JP | 2000-349576 | 11/2000 |

* cited by examiner

*Primary Examiner*—Hai Pham
(74) *Attorney, Agent, or Firm*—Howrey LLP; Vinay V. Joshi

(57) ABSTRACT

The present invention uses an open loop feedback technique to control emissive pixels of a printhead of a printer. The open loop feedback technique involves integrating the light intensity of the emissive pixel over a predetermined period of time, averaging the integrated value, comparing the averaged value to a threshold value, and adjusting the input voltage to the OLED of the pixel based on the comparison.

30 Claims, 17 Drawing Sheets

FEEDBACK CONTROL APPARATUS AND METHOD FOR AN EMISSIVE PRINTHEAD

RELATED APPLICATION

This application claims the benefit of U.S. Provisional Application No. 60/660,725, filed Mar. 11th, 2005, which is incorporated herein by reference.

FIELD OF THE INVENTION

The present invention relates to printing technology, and specifically to controlling the printhead of a printer using feedback control techniques.

BACKGROUND OF THE INVENTION

A printhead is a part of a computer printer that contains the printing elements. The printing elements include light emitting elements such as lasers that are used to write information such as graphic images and alphabetic text to a drum coated with a light sensitive material such as a selenium compound. The drum acquires a charge proportional to the intensity of the light. The charges on the drum replicate a desired image. The drum is then rotated through a toner application system, which coats the drum with the toner. The thickness of the coat of the toner is controlled by the charge on the drum. The drum continues to rotate and transfers the toner to a blank sheet of paper.

Alternatively, the light emitting elements can be used to directly write an image to a light sensitive medium such as photographic paper. FIG. 1 illustrates how the printhead 10 is used to write a two-dimensional image. The drum 20 or paper 20 moves with respect to the printhead 10, which is held stationary as the paper 20 or drum 20 moves past the printhead 10. Data is fed to the printhead 10 for each line of the image. The size of the image dots written to the drum 20 or paper 20 depends on the velocity of the drum 20 or paper 20. For example, if the printhead 10 holds the line data for one millisecond and the paper 20 moves at the velocity of 10 cm/second the image dot is 0.1 millimeters long.

After the first line is written, the data in the printhead 10 is replaced by the image data for the second line. Since this takes some time, the paper 20 has moved causing a separation from the first image line on the drum 20 or paper 20. The second line is written to the drum 20 or paper 20 when the next line of data is sent to the printhead 10. This process continues until the completed image has been written to the drum 20 or paper 20.

A new organic light emitting diodes (OLED) technology, which replaces the laser with an OLED as the light emitting elements, is simpler, faster and superior in resolution to the laser technology. However, the lack of manufacturing uniformity and differential color aging of the OLED over the lifetime of the products that implement the OLED are hindering the commercialization of the OLED technology.

Nuelight Corporation, the assignee of the present application, has several pending provisional and non-provisional patent applications that relate to improving the use of light emitting elements, for example, OLED, to illuminate displays such as the LCD displays. See, for example, U.S. patent application Ser. No. 10/872,344 entitled Method and Apparatus for Controlling an Active Matrix Display and U.S. patent application Ser. No. 10/872,268 entitled Controlled Passive Display Apparatus and Method for Controlling and Making a Passive Display. Those patent applications relate to the use of feedback systems to control the emissions of the display pixels.

The techniques of the present invention relate to improving the use of light emitting elements, for example, OLED, in printhead applications. The light emitting elements serve different purposes in the printheads than in the displays. In the displays, for example, in the liquid crystal displays (LCD), millions of light emitting elements are arranged in two-dimensional arrays to illuminate the display pixels. In printheads, on the other hand, the light emitting elements are arranged in a linear array to write information to a drum or a photographic paper via emissive pixels.

The challenges associated with the application of the light emitting elements to the displays and the printheads are different. The displays are inherently restrictive in the amount of area the feedback sensor circuitry can occupy because each pixel is surrounded by other pixels, and therefore, a feedback sensor must be included inside a pixel area. The printheads, on the other hand, use linear arrays in which a pixel is not surrounded by other pixels and so the feedback sensor can be mounted outside the pixel, for example, above or below the pixel. The techniques of the present invention relate to using the emission of light emitting elements of a printhead as feedback signals to control the light emitting elements.

SUMMARY OF THE INVENTION

The present invention relates to a technique for controlling an emissive pixel of an array of emissive pixels of a printhead of a printer using an open feedback loop. A light emitting element of the emissive pixel is optically coupled to a sensor. Several values of an output parameter such as the intensity of the light emitted by the light emitting element are measured over time by the sensor and converted to measurable parameter values such as voltage values. The measurable parameter values are integrated and then averaged. The averaged value is compared to a threshold value and the result is used to adjust an input parameter for the light emitting element, such as the voltage signal provided as an input to the light emitting element.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
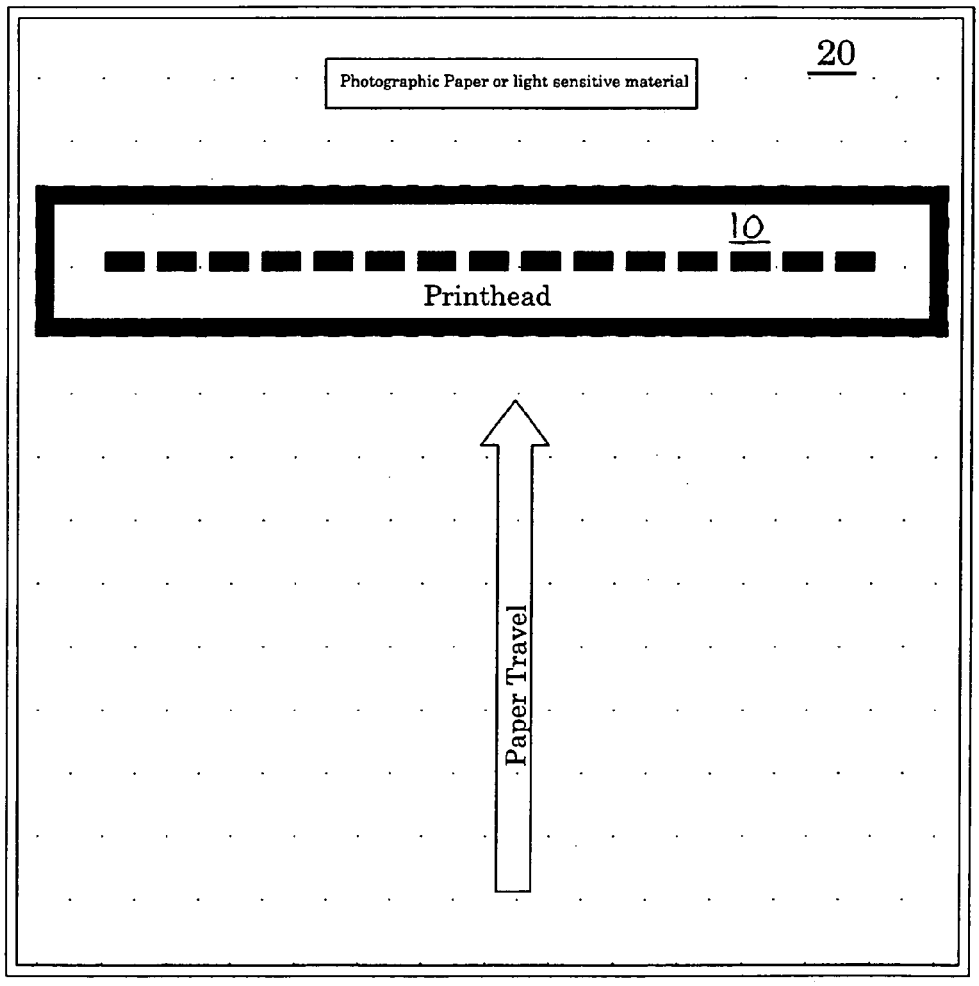
FIG. 1 illustrates an exemplary embodiment of a printer including a printhead and an image-recording medium.
Figure 2:
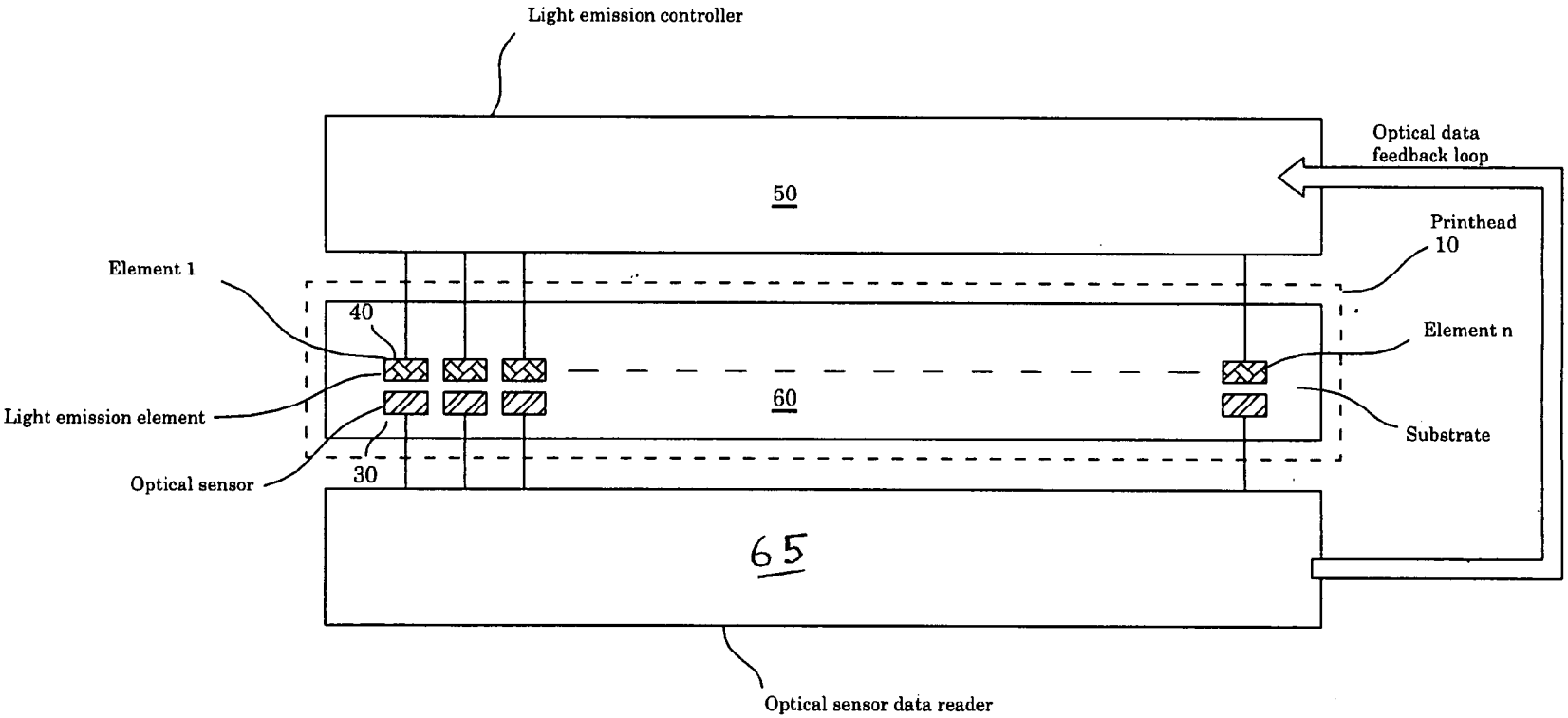
FIG. 2 illustrates an exemplary embodiment of a printhead implemented in a passive matrix configuration.

This present invention relates to the use of optical feedback to control and maintain pixel brightness and uniformity over time in a printhead 10. As shown in FIG. 2, a linear array of optical sensing elements 30 are deposed in a one-to-one correspondence adjacent to the linear array of light emitting elements 40. The emission data read by the optical sensors 30 is fed back to the control circuitry 50 that regulates the emission levels of the light emitting elements 40.

Figure 3:
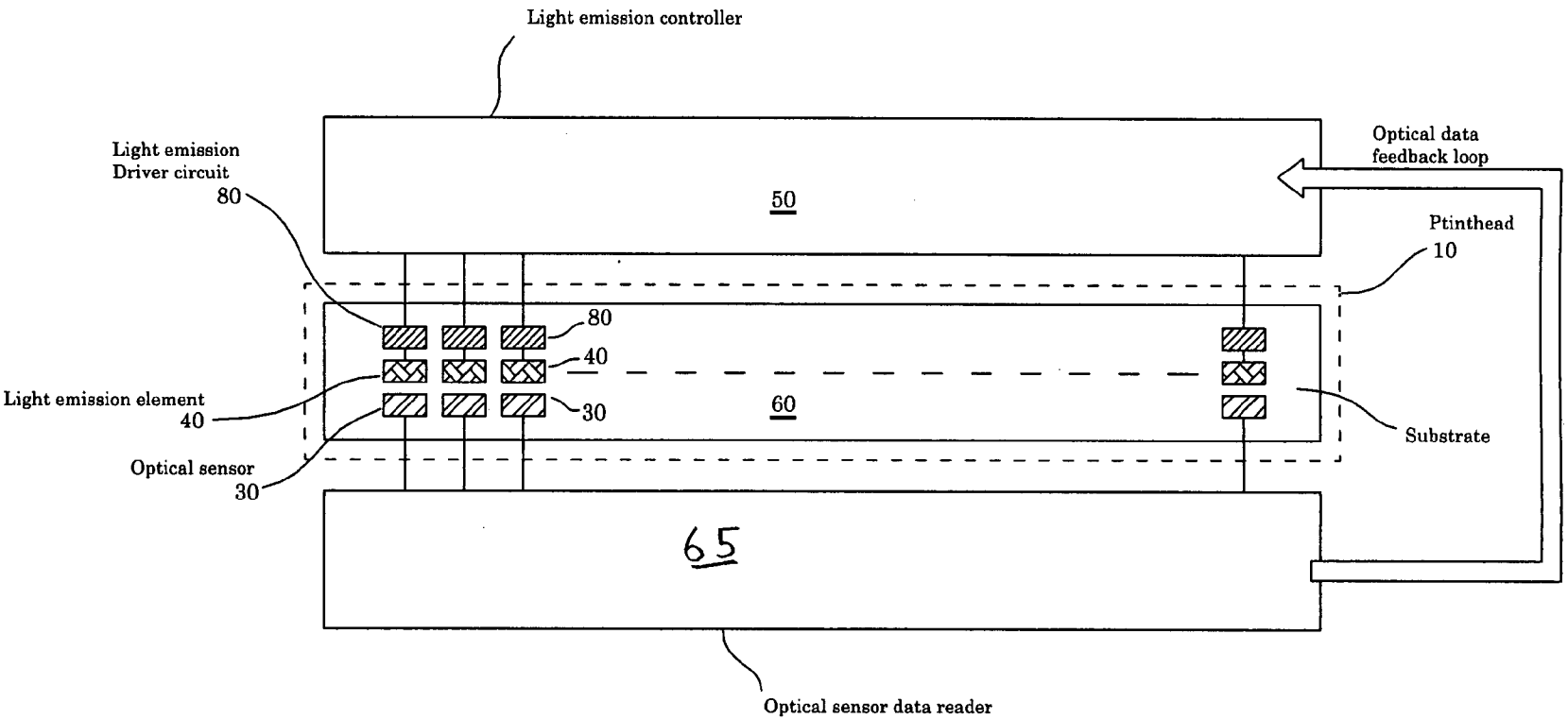
FIG. 3 illustrates an exemplary embodiment of a printhead implemented in an active matrix configuration.
Figure 13:
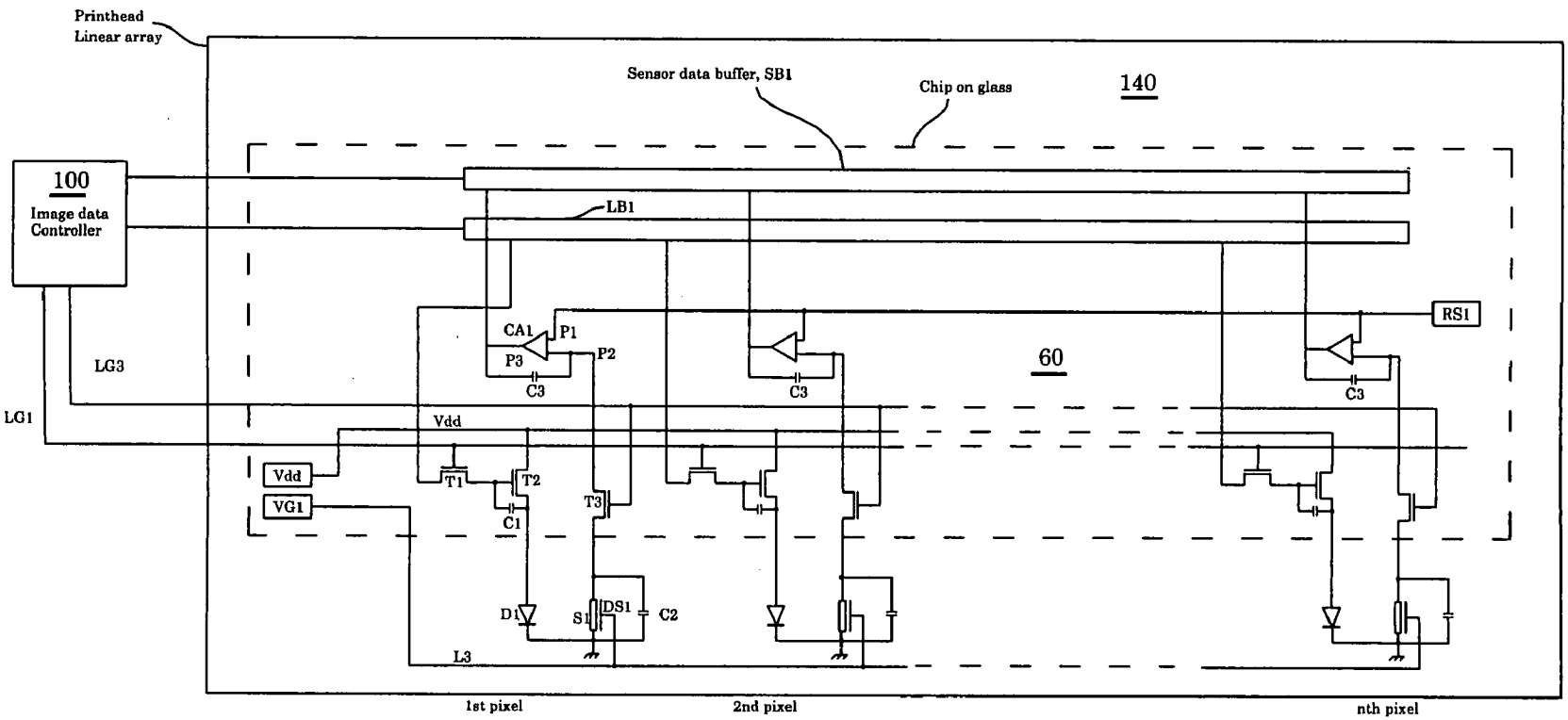
FIG. 13 illustrates an exemplary embodiment of a printhead implemented in a Chip On Glass (COG) configuration having an open loop feedback control.
Figure 14:
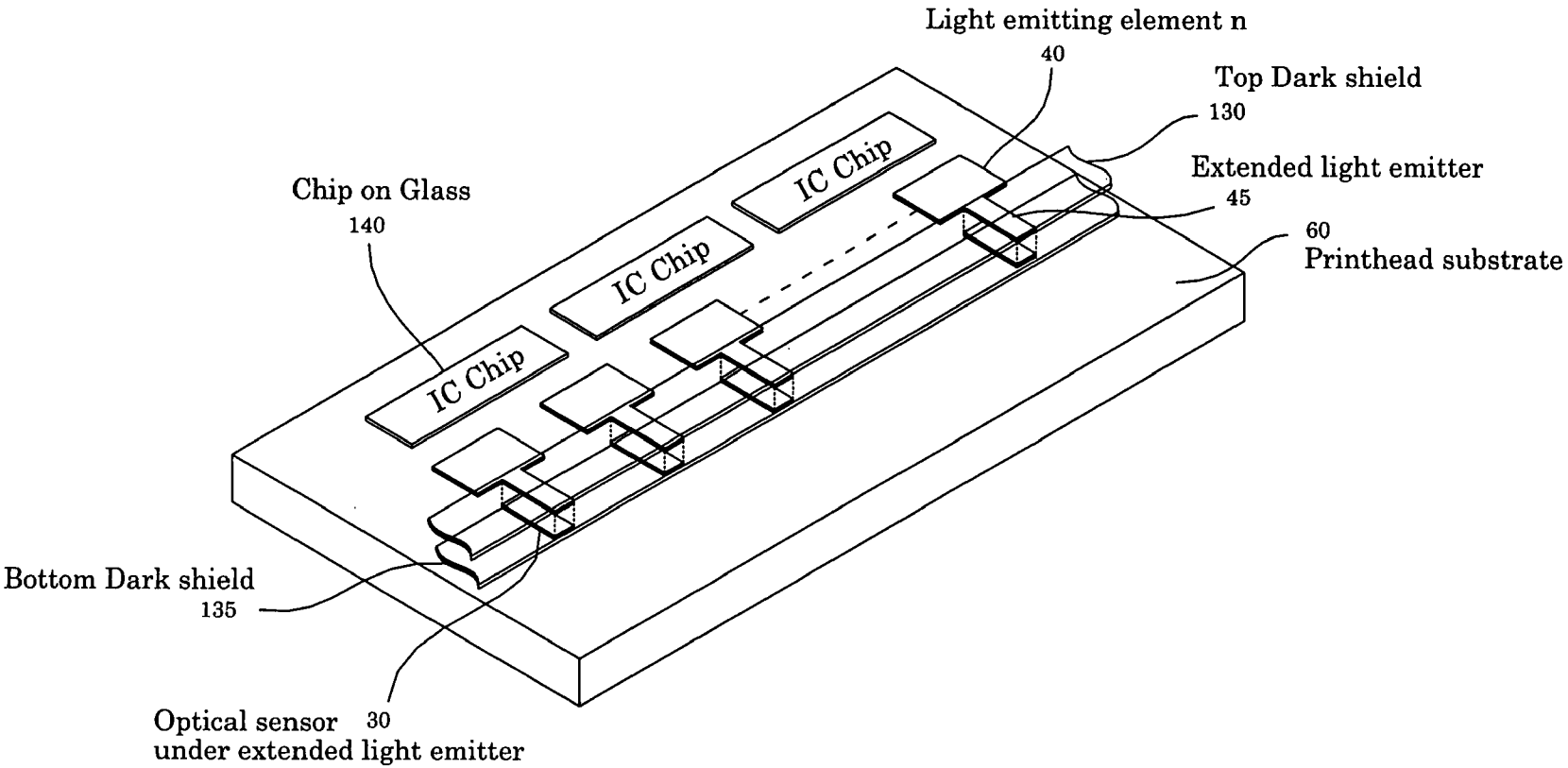
FIG. 14 illustrates an exemplary Chip On Glass (COG) topology.

The present invention can be implemented with either passive matrix controlled pixels as shown in FIG. 2 or with active matrix controlled pixels as shown in FIG. 3. An advantage of the active matrix pixel control, in which the drive circuitry 80 that drives the light emitting elements 40 is located on the printhead substrate thin film 60, is the reduction of input/output (IO) lines to the printhead 10. An alternative to active matrix circuitry is the use of chip on glass (COG) technology for pixel and optical sensor control and feedback as shown in FIGS. 13 and 14.

Referring to FIGS. 2 and 3, if the printhead 10 is printing to a light sensitive drum 20 that will pick up toner, the light emitting materials 40 are selected to emit the optimum wavelength required by the sensitive drum. If, however, the printhead 10 is used to expose a photographic color medium 20, there must be three light emitting linear arrays, for example, a red array, a green array, and a blue array, or alternatively the printhead 10 may contain a linear array of light emitters 40 in which for example, every third light emitter is red, every third is green and every third is blue.

Since the light emitters 40 are deposed in a single row (linear array) there is no need to insert either pixel drive circuitry 80 or sensor circuitry 30 within the pixel area itself, but both circuitries 80 and 30 may be located adjacent to the light emitting elements 40 and in an array of circuits extending along side in thin film form, as illustrated in FIG. 3. Alternatively, both circuitries 80 and 30 can be off the printhead substrate 60 employing multiple-line flexible connectors and a Chip On Glass (COG) form leading to a printed circuit board containing feedback and pixel control functions. If a high-speed thin film semiconductor is employed, all the drive circuitry 80 may be located on the printhead 10 thereby minimizing input/output leads to the printhead 10.

The optical sensor data reader 65 interface the sensor 30 to the control circuitry 50. The optical sensor data reader 65 also coverts the light intensity measured by the sensor 30 into a measurable parameter, for example, a voltage value. The geometric relationship shown between the reader 65 and the control circuitry 50 is exemplary and many other geometric relationships between the two 50, 65 are possible. For example, in one embodiment, both the reader 65 and the control circuitry 50 may be located on the same side of the light emitters 40.

Figure 4:
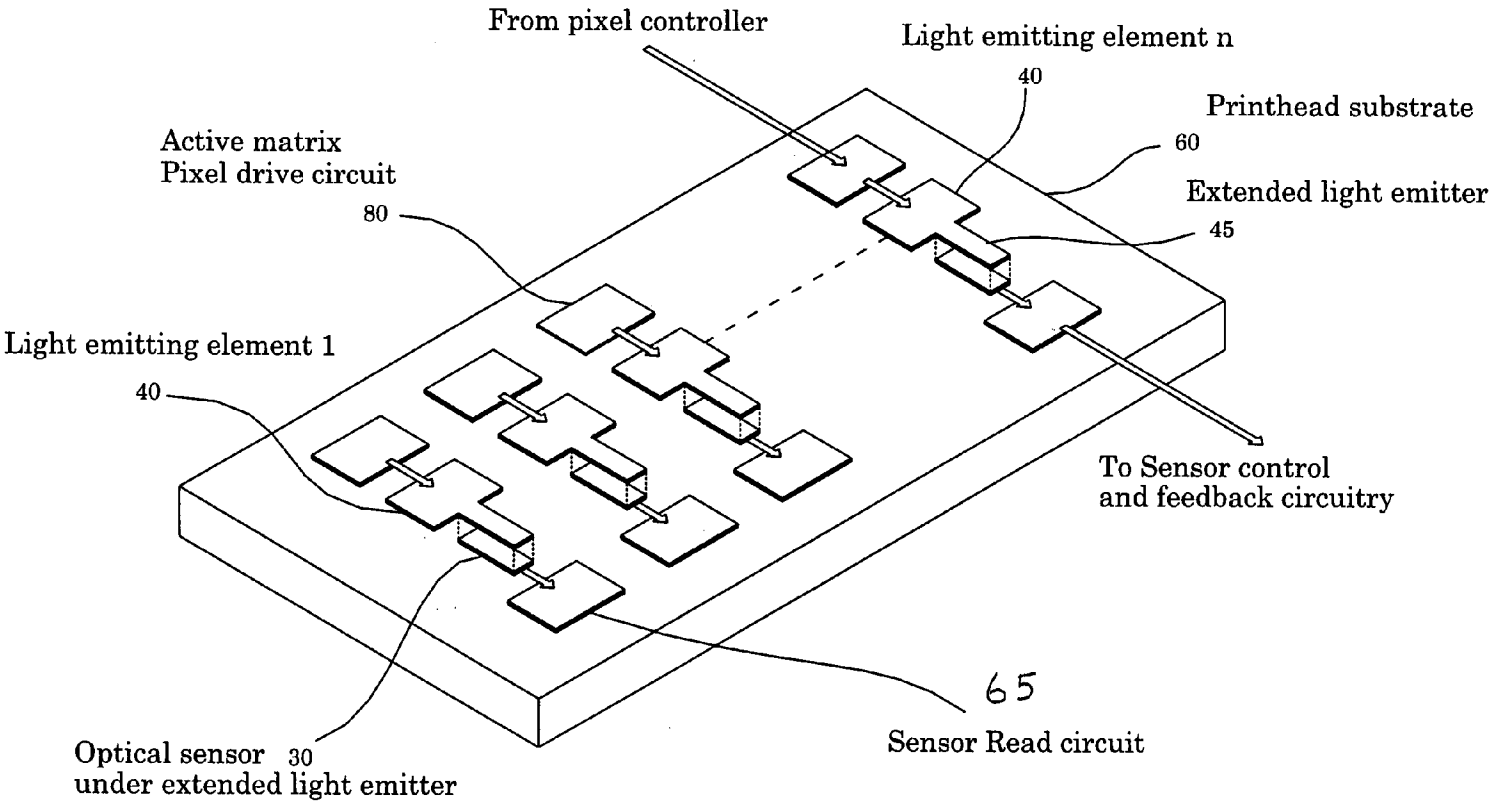
FIG. 4 illustrates another exemplary embodiment of a printhead implemented in an active matrix configuration.

In one embodiment, as illustrated in FIG. 4, an enhanced optical coupling of the optical sensors 30 with the light emitting elements 40 is accomplished by having an extended section of the pixel light emitting element 45 outside the pixel area to overlap the optical sensors. The present invention uses a luminance feedback to stabilize and make uniform the linear arrayed light emitting elements 40 in a printhead 10. The light emitting elements 40 are used to write an image to light sensitive materials 20 including photographic media 20 and materials designed to pick up toner inks 20 for transfer to non-optically sensitive materials such as paper stock, transparencies and others.

Feedback systems are typically sorted into three broad classes: closed loop, open loop, and interrupted loop feedback systems. The closed loop is a system in which a change is detected in the output of a system and directly fed back to the input, which causes another output, which is again fed back to the input. An oscillator is an example of a closed loop system. If there is enough damping in an oscillating system the system will eventually settle to a constant output value. The exact value and the time it takes to settle are dependent on the loop parameters.

The open loop system does not feed back output values directly to the system input. Rather an output value is measured, evaluated and the result of the evaluation is used to make a decision on changing the input at a point in the future. The interrupted loop starts with a varying input and as the output varies it is measured and compared to a reference. When the output matches the reference the input is interrupted and input value held; thus, the output is fixed at a desired value determined by the reference. This is a fast and highly accurate method to achieve a desired output. The present invention uses both the interrupted loop and the open loop systems.

Figure 5:
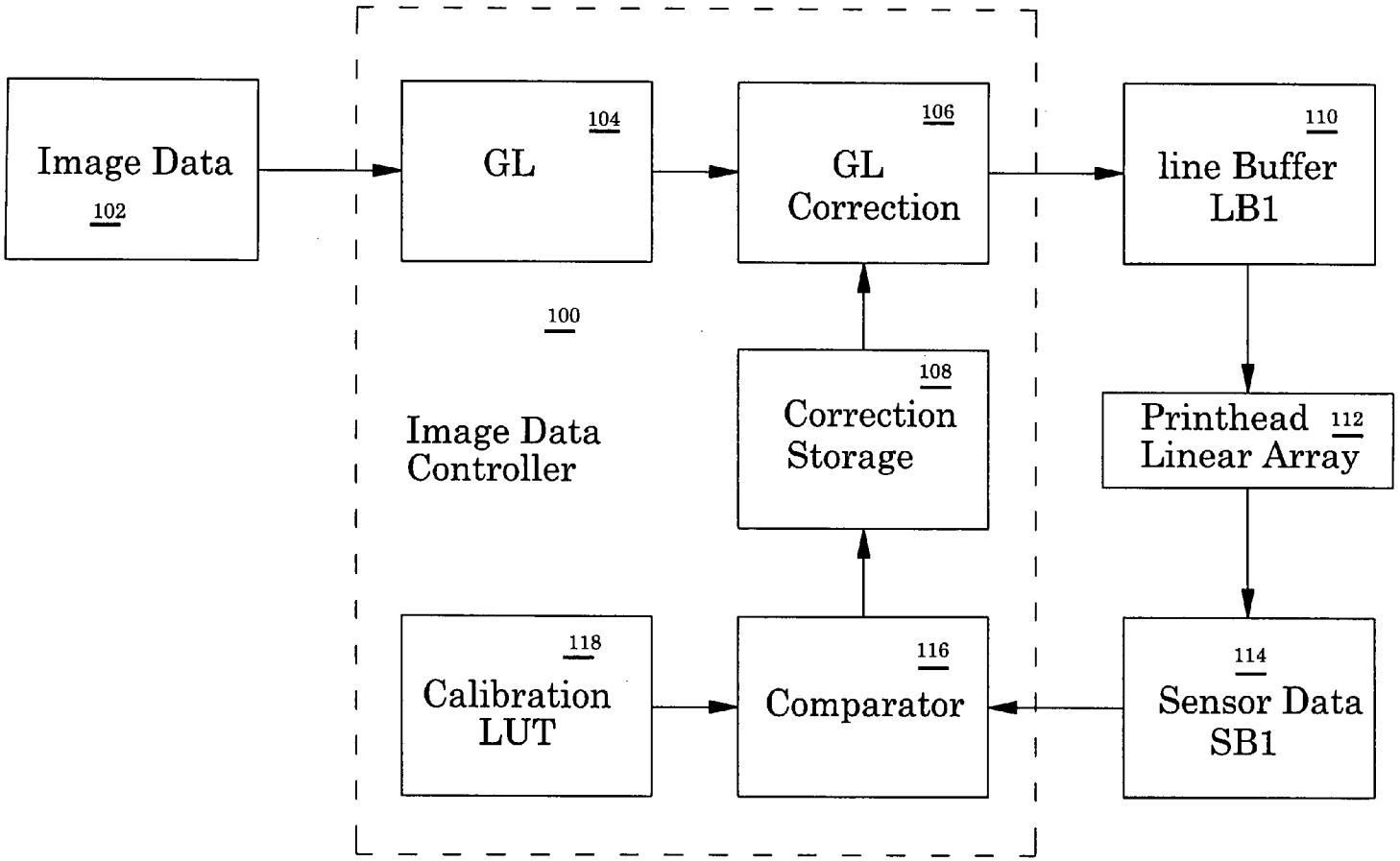
FIG. 5 illustrates an exemplary flow chart of a method of the present invention.

A method of the open loop feedback system of the present invention is now described with reference to the flow chart of FIG. 5. FIG. 5 illustrates the functionality of the image data controller 100. Image data 102 is fed to the gray level block (GL) 104, which converts the image data to gray levels. The number of gray levels depends on the number of bits used to define the gray level. For example, a 1 bit gray level has two levels—on or off. An 8-bit gray level has 0 to 255 levels of gray. The image data is a serial data stream of analog pixel values (voltages). An analog pixel voltage enters block GL 104 and a digital number representing the gray level corresponding to the analog voltage exits.

The digital gray level value enters block GL Correction 106 and may or may not be changed depending on the information inputted from block Correction Storage 108. The gray level value (changed or unchanged) exits the GL Correction block 106 and enters the Line Buffer (LB1) block 110, which collects pixel values until one line of pixels is collected, at which point the total line of pixel values is down loaded to the Printhead Linear Array block 112.

The values of the down loaded pixels determine the luminance levels of the light emitters in the printhead. The value of the luminance over the time the printhead is on is collected and read to the Sensor Data (SB1) buffer block 114. The sensor data is sent to the Comparator block 116, which compares the sensor data to calibration (reference) data sent to the Comparator block 116 from the Calibration LUT (look-up table) block 118. The two pieces of data are subtracted and the resulting value is sent to the Correction Storage block 108. The values stored in the Correction Storage block 108 are gray levels or portions of gray levels that will be added or subtracted from the initial gray level determined from the incoming image data and converted to a gray level in the GL block 104.

FIG. 5 illustrates an open loop system. The advantage of this system is that the luminance data is collected during a time interval, which will tend to cancel out random noise generated in the optical signal plus the optical signal will be amplified by a factor determined by dividing the measurement time into the integration time. For example, if the time interval (integration time) is 800 microseconds and the measurement time is 8 microseconds the amplification is 100 times or 20 dB. Various embodiments of the present invention are now described in detail with references to FIGS. 6–16.

Figure 6:
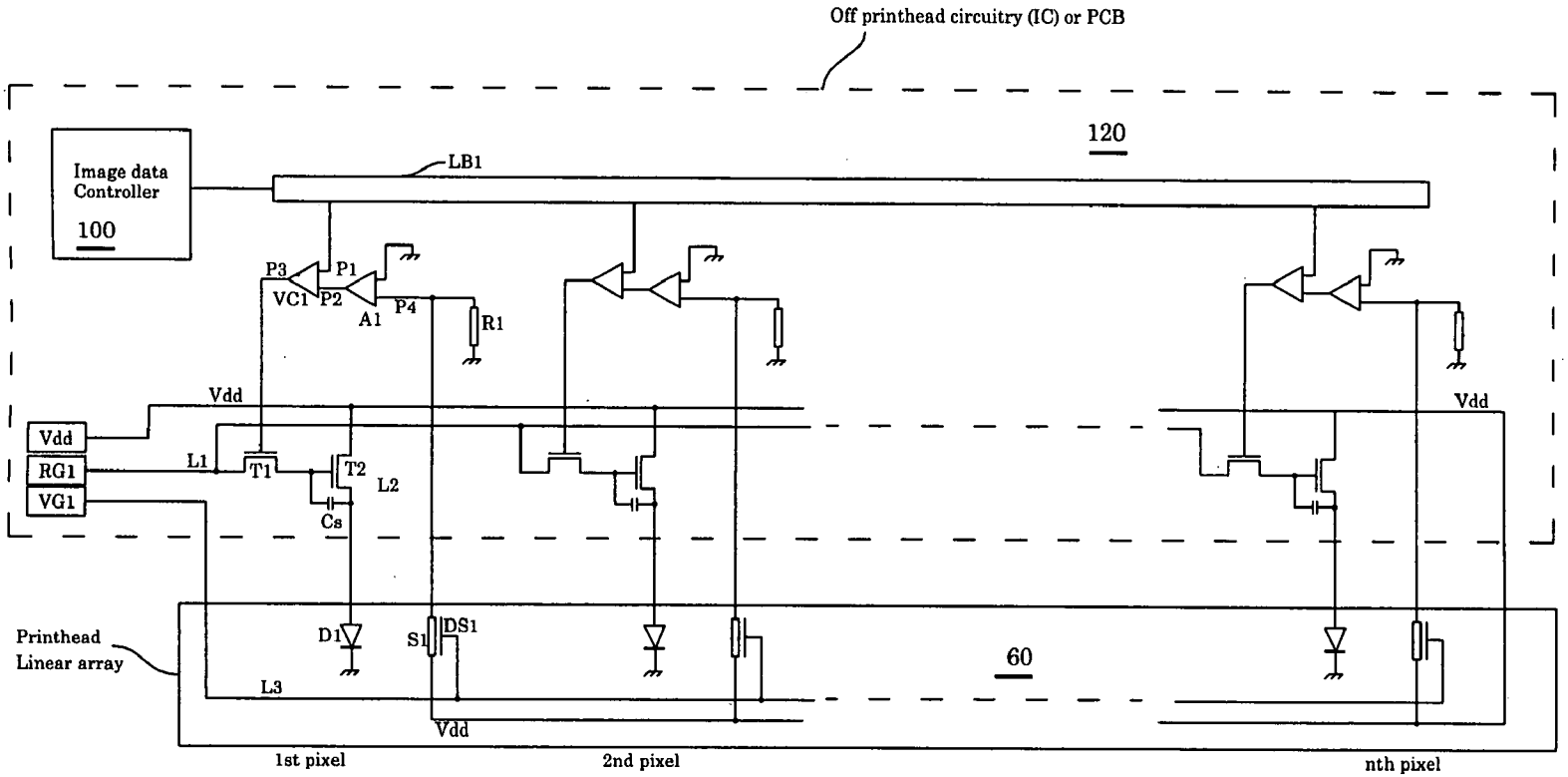
FIG. 6 illustrates an exemplary embodiment of a printhead implemented in a passive matrix configuration having an interrupted loop feedback control.

In one embodiment of the present invention, an interrupted loop feedback control is implemented in a printhead 10 having a passive matrix configuration. Referring to FIG. 6, the printhead substrate 60, which may be glass in the case of a down-emitter OLED (organic light emitting diode), or of an opaque material in the case of an up-emitter. The terms "down-emitter" and "up-emitter" are familiar terms used in the OLED display industry signifying whether or not the light emitted by the OLED materials passes down through the substrate or up and away from the substrate. Both systems are in common use in the industry, but present developments favor the up-emitter, because thin film circuitry does not interfere with the light path.

In the case of the printhead, light is not interfered with in either case since the thin film circuitry and sensing elements are not under the light emitting elements as illustrated in FIG. 3, which shows the light emitting elements 40 running linearly down the center of the printhead substrate 60 with the pixel driver circuitry 80 in the upper third of the substrate 60 and the optical sensor array 30 in the bottom third of the substrate 60.

The substrate 60 can be fabricated by using techniques well known in the semiconductor industry including material deposition processes including but not limited to evaporation, sputtering and plasma enhanced chemical vapor deposition; etching processes including but not limited to wet chemical etching, reactive ion etching and sputter etching; and photolithographic processes.

It is understood that the light emitting elements 40 may be formed from a number of light emitting materials including but not limited to organic light emitting diode materials such as Kodak's small molecule material, the polymer OLED materials, and phosphorescent OLED materials introduced by Universal Display Corporation. Other light emitting materials include electroluminescent materials and inorganic materials such as the indium phosphides used in the well-known red LEDs.

This embodiment shown in FIG. 6 is referred to as a passive matrix because all the light emitter drive 80 circuitry is off the printhead substrate 60 and in an integrated circuit (IC) 120 or on a printed circuit board (PCB) 120. The only circuit components on the printhead substrate 60 are the light emitting elements 40 and the optical sensors 30. The interrupt feedback loop embodiment of FIG. 6 operates by generating image data in the form of a serial analog voltage signal that enters the Image Data Controller 100, which then sends gray level voltages to the line buffer LB1. These gray level voltages are sent to pin P1 of voltage comparator VC1. There is one P1 and VC1 for each light emitter 40 in the printhead linear array. The first light emitter 40 is labeled $1^{st}$ pixel and the second light emitter 40 is labeled $2^{nd}$ pixel and so on until the last light emitter 40, which is labeled nth pixel. There may be any number of light emitters 40 in the linear array depending on the dots per inch and the total length of the array.

Initially there is no voltage on pin P4 of amplifier A1 and therefore when the gray level voltage is applied from line buffer LB1 to pin P1 of VC1, there is no voltage on pin P2 of VC1. VC1 is designed so that when pin P1 has a higher voltage than pin P2, the output of VC1 pin P3 is on the positive voltage rail, which, for example, may be +15 volts. Therefore, a positive 15 volts is applied to all the gates of transistors T1 in the IC chip or PCB. Simultaneously voltage generator Vdd applies a voltage, for example, 10 volts to the drains all the T2*s* and sensors S1 and ramp generator RG1 begins to ramp up voltage to the drains of all the T1*s*.

It is understood that sensor S1 may be formed from any optically sensitive material including but not limited to amorphous silicon, poly-silicon, cadmium selenide, cadmium sulfide, and tellurium sulfide to name a few. The ramp voltage is transferred to the gates of all the T2*s* and the capacitors Cs, because of the plus 15 volts on the gates of the T1*s*. As the ramp voltage increases, T2 begins to force current through light emitting element, D1 causing the emission of light to illuminate sensor S1. The current generated by S1 can be fine tuned by the voltage placed on dark shield DS1 (which acts as a gate element to the sensor).

Due to the optical current flowing from sensor S1 through resister RI to ground, the voltage on pin P4 begins to increase causing the output voltage from A1 to be placed on pin P2 of voltage comparator VC1. The gain of A1 is designed to amplify the voltage from the optical current so as to be compatible with the gray level voltage on pin P1 of VC1. As the ramp voltage further increases, the resulting increased optical current increases the voltage on pin P4, and thus, the voltage on pin P2 of VC1. At some point in the voltage ramp the luminance of D1 is high enough that the voltage from the optical current causes the voltage on pin P2 to exceed the voltage on P1, at which point the output voltage on pin P3 of VC1 switches to the negative rail placing, for example, −5 volts on the gate of T1, thus, locking the ramp voltage on capacitor Cs and the gate of T2.

Each T1 in the array will be turned off at a time determined by the gray level voltage that was placed on pin P1 of VC1. It is understood that the number of gray levels is purely arbitrary and can range from two to thousands of levels depending on the application. The actual gray level voltage depends on the calibration of the sensor and the driver circuitry for the light-emitting element. Therefore, calibration data is taken for each driver 80 and sensor circuit 30. This is optional depending on the uniformity of the semiconductor processes and the optical response of the optical sensor S1. The calibration data is stored in the Image Data Controller 100 and is used to modify the image data entering the Image Data Controller. There are many methods known in the art to do this; therefore, the details of how this is done are left to the printhead system designer.

As circuits age and/or the light emitters 80 age, the brightness caused by a particular voltage placed on the gate of T2 decrease. This may be caused by the light emitter becoming less efficient or by the circuit parameters of T2 drifting over time. In either case, the ramp voltage will continue to increase the voltage on the gate of T2 until the emission of D1 is high enough to cause the output of VC1 pin P3 to switch to the negative rail, and thus, switching off T1 and locking the ramp voltage on the gate of T2 and capacitor Cs. Therefore, as the circuit and light emitter age, the voltage on the gate of T2 increases keeping the light emission at the correct level for the desired gray level.

Figure 7:
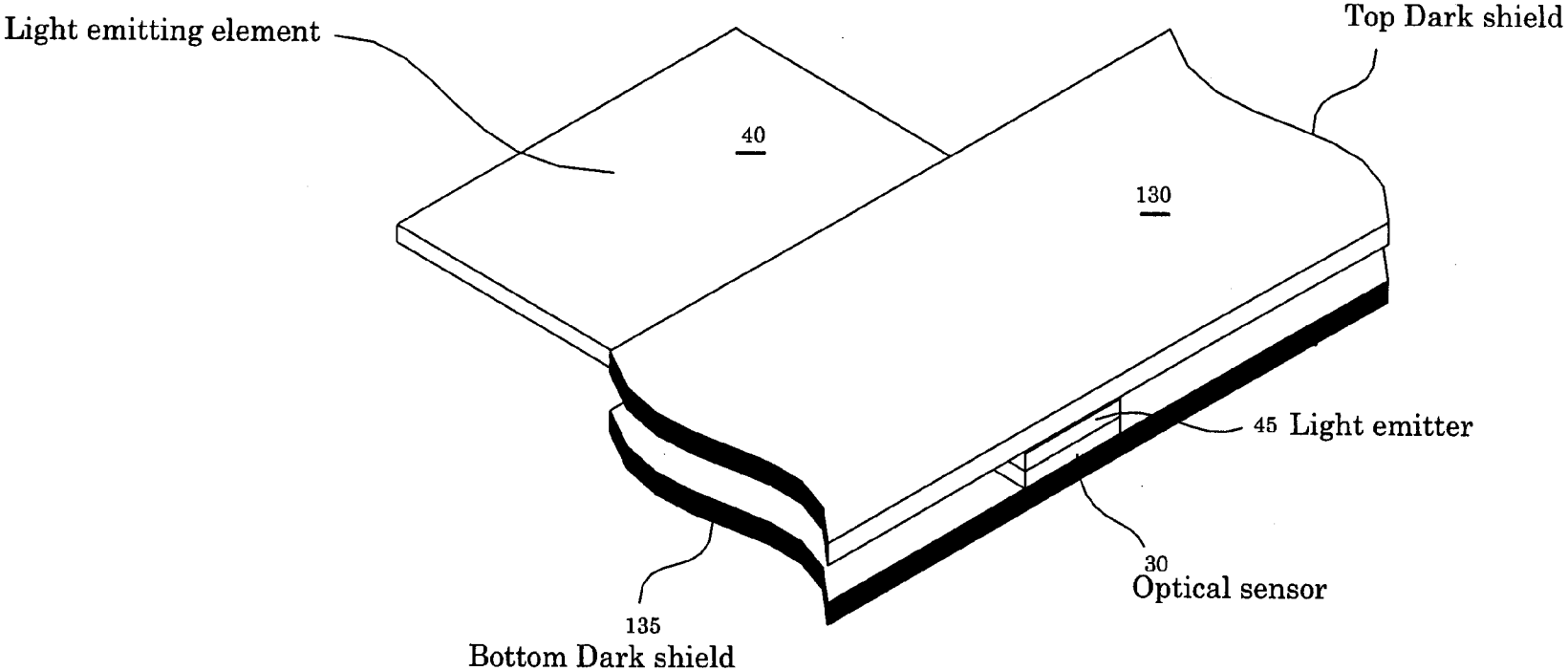
FIG. 7 illustrates an un-exploded view of an exemplary embodiment of a printhead implementing protective optical shields around a light emitter coupled to an optical sensor.
Figure 8:
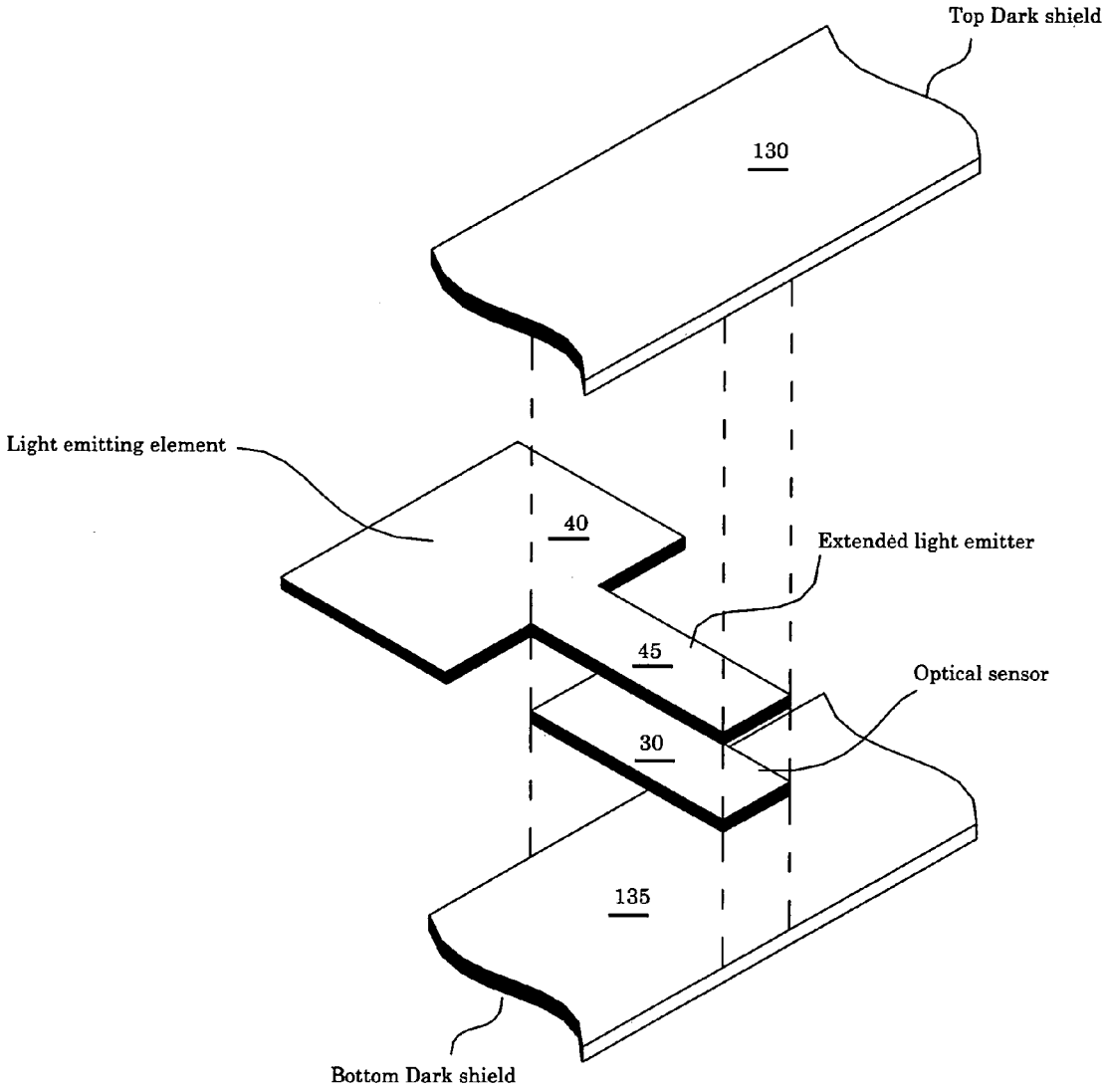
FIG. 8 illustrates an un-exploded view of an exemplary embodiment of a printhead implementing protective optical shields around a light emitter coupled to an optical sensor.

If fine levels of gray are required, cross talk between adjacent light emitters and optical sensors can become a problem; therefore means can be provided to reduce optical cross talk. FIG. 7 shows the apparatus for minimizing optical cross talk by the use of dark shields 130,135 to block both ambient light noise and noise from adjacent light emitters 40. FIG. 8 is an exploded view for clarity. In a transparent substrate such as those used by down-emitter systems, light can travel from a light emitter 40 over to the adjacent optical sensor 30 in the substrate glass or other transparent medium.

Figure 9:
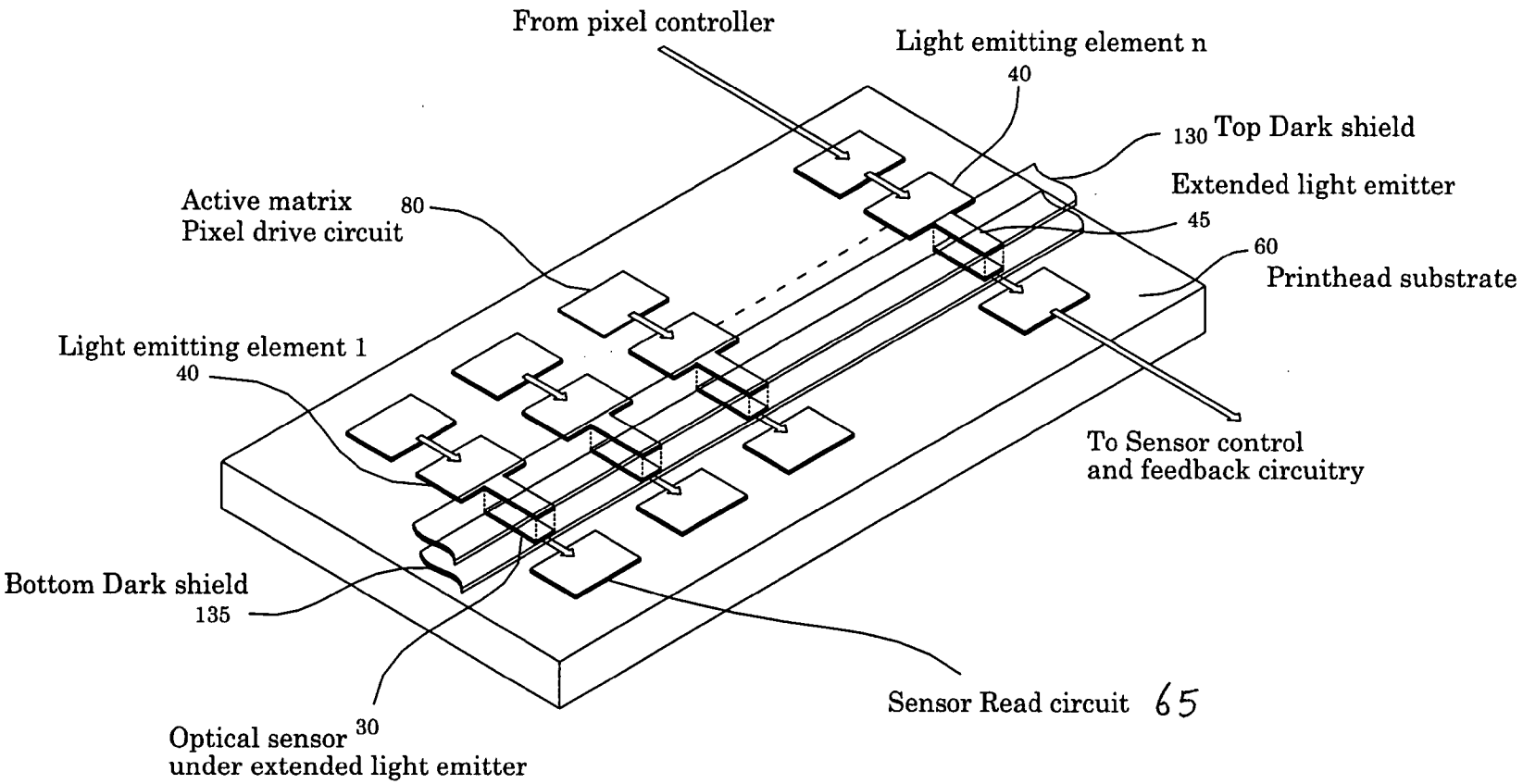
FIG. 9 illustrates an un-exploded view of another exemplary embodiment of a printhead implementing protective optical shields around a light emitter coupled to an optical sensor.

A dark shield 130,135 constructed of opaque material such as a metal is deposed on the glass and under the optical sensor 30. This shield is designated in the drawing as the Bottom Dark Shield 135. To protect the sensor from light from the top of the light emitter/optical sensor stack a Top Dark Shield 130 is deposed. Optionally, one or the other or both can be used depending on the circumstances. These dark shields 130,135 may be used in any of the embodiments described herein. FIG. 9 shows the dark shields 130,135 may be continuous strips of opaque material running the length of the linear array of optical sensors 30.

Figure 10:
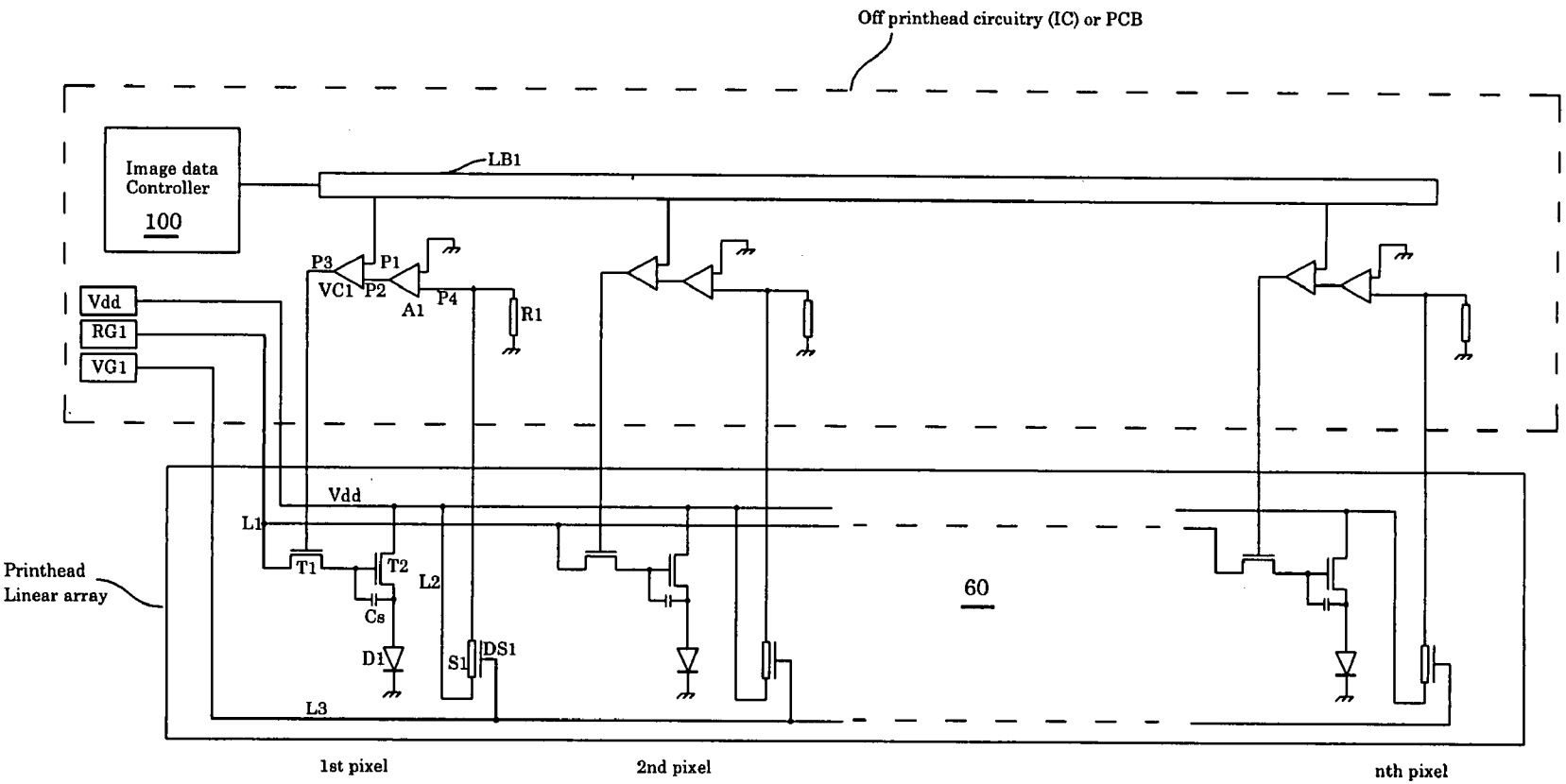
FIG. 10 illustrates an exemplary embodiment of a printhead implemented in an active matrix configuration having an interrupted loop feedback control.

FIG. 10 shows the active matrix embodiment of the interrupted loop feedback system. In this embodiment, some of the pixel drive circuitry 80 is deposed on the printhead substrate 60. The circuitry is constructed using thin film semiconductor technology well known in the industry. The semiconductor materials may be any suitable semiconductor, including but not limited to amorphous silicon, polysilicon, or cadmium selenide naming a few. The figure shows that the data transfer TFT T1, storage capacitor Cs and TFT T2 have been deposed on the printhead substrate 60.

It is understood that any amount of the attendant circuitry may be deposed onto the printhead substrate 60 depending on the speed of the semiconductor material used. For example, if high quality poly-silicon is used the speed is high enough to depose thin film circuitry on the printhead that includes the high speed line buffer LB1 and the operational comparators and amplifiers, VC1 and A1. The operation of this embodiment of FIG. 10 is an interrupted loop and is identical to the embodiment discussed above with reference to FIG. 6. The advantage of this embodiment is the reduction of input/output lead to the printhead 10. The cost, on the other hand, may be higher due to the requirement for high-speed thin film materials and the added yield loss due to the added circuit complexity.

Figure 11:
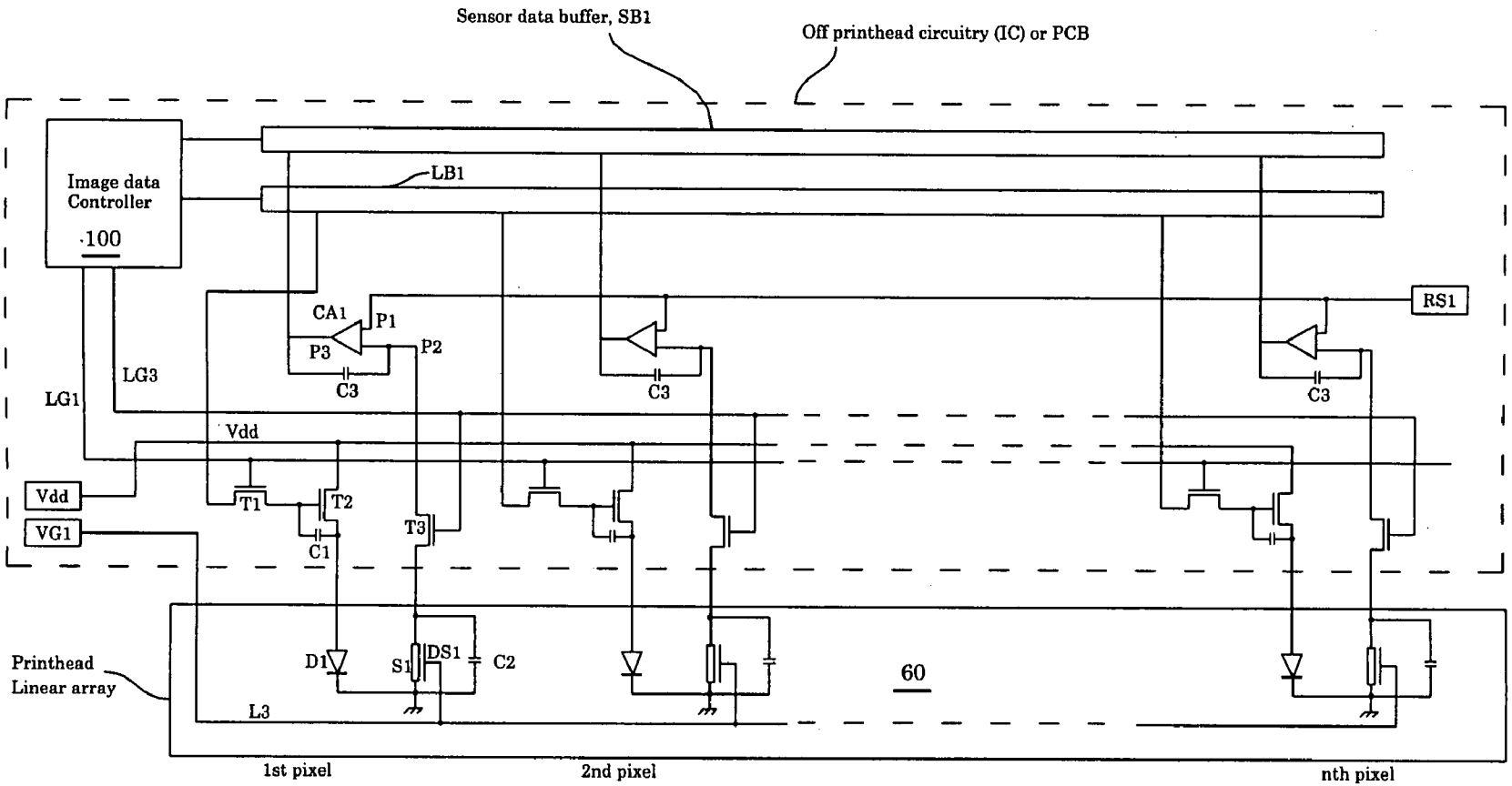
FIG. 11 illustrates an exemplary embodiment of a printhead implemented in a passive matrix configuration having an open loop feedback control.

FIG. 11 shows an example of a circuit schematic for a photon integration open loop feedback system. On the printhead substrate 60 are deposed the linear array of light emitting elements D1 from the first pixel to the nth pixel. Deposed adjacent to the light emitting elements D1 are optical sensors S1. The dark shields are designated DS1 and are connected to line L3 which is driven by voltage generator VG1. The use of the voltage placed on DS1 has been explained above with reference to FIG. 6. Shorting across S1 is capacitor C2. One side of both S1 and C2 are connected to ground as is the cathode of D1.

This is a passive matrix because there are no active devices deposed on the printhead substrate 60. It could be argued that dark shield DS1 causes optical sensor S1 to be an active device, but the distinction between active and passive has traditionally been determined by where the pixel driving circuit is placed-either on the substrate 60 locally with the pixel (active) or off the glass and out of the active area of the display (passive).

To initialize the circuit, voltage, 10 volts for example, is applied to P1 of CA1. CA1 is a charge amplifier and when 10 volts is applied to pin P1 10 volts appears on pin P2 and charges the line connecting pin P2 to the drain of TFT T3. To complete the initialization the Image Data Controller 100 sends a voltage to the gate of TFT T3, which charges C2 to 10 volts. In operation the Image controller 100 (see above for details of the Image Controller 100) sends pixel data voltages to line buffer LB1. These data voltages in analog form are down loaded to the TFT T1*s* in all the pixels in the linear array of light emitting elements. The Image Data Controller 100 then sends a gate voltage to all the TFT T1*s* which causes the data voltages to transfer to the gates of all the TFT T2*s* and the storage capacitor C1*s*.

After the address time, TFTs T1 are turned off by the Image Data Controller 100 removing voltage from the gates of TFTs T1. Storage capacitor, C1 then maintains the voltage on the gates of TFTs T2 for the design on-time of the pixel. Consequently TFT T2 is turned on and current is forced through light emitting elements D1; therefore, causing light emitting elements D1 to emit light which impinges on optical sensors S1. The 10 volt charge placed on capacitor C2 is drained to ground through optical sensor S1. The rate at which C2 is drained depends on the level and time duration of the light emitted by D1. Therefore the amount of charge drained over the illumination time interval is a measure of the photo emission level (photon flux) from D1.

After the design on-time for the pixels the pixels are turned off by sending 0 Volts (or grounding the drains of TFTs T1) to capacitor C1, and thus, removing the gate voltages on TFTs T2 in the linear array. During the ensuing dark period before the next line of data voltages is downloaded (this is analogous to the horizontal retrace time in the display industry) the Image Data Controller 100 sends a voltage to the gates of TFTs T3 causing charge amplifier CA1 to recharge to 10 volts capacitor C2. The amount of charge required to recharge C2 to the 10 Volts is drained from charge amplifier capacitor C3 causing a voltage to appear on pins P3 of charge amplifiers CA1. The level of the voltage on pin P3 depends on the amount of charge and the ratio of C2 to C3. The voltage on pin P3 is collected in Sensor Data Buffer SB1 114 where it is sent to the Image Data Controller 100 to be processed and compared to calibration voltages and the results are stored to be used in later image frames to modify the initial gray level data. See the functional description of the open feedback loop system above with reference to FIG. 5.

Figure 12:
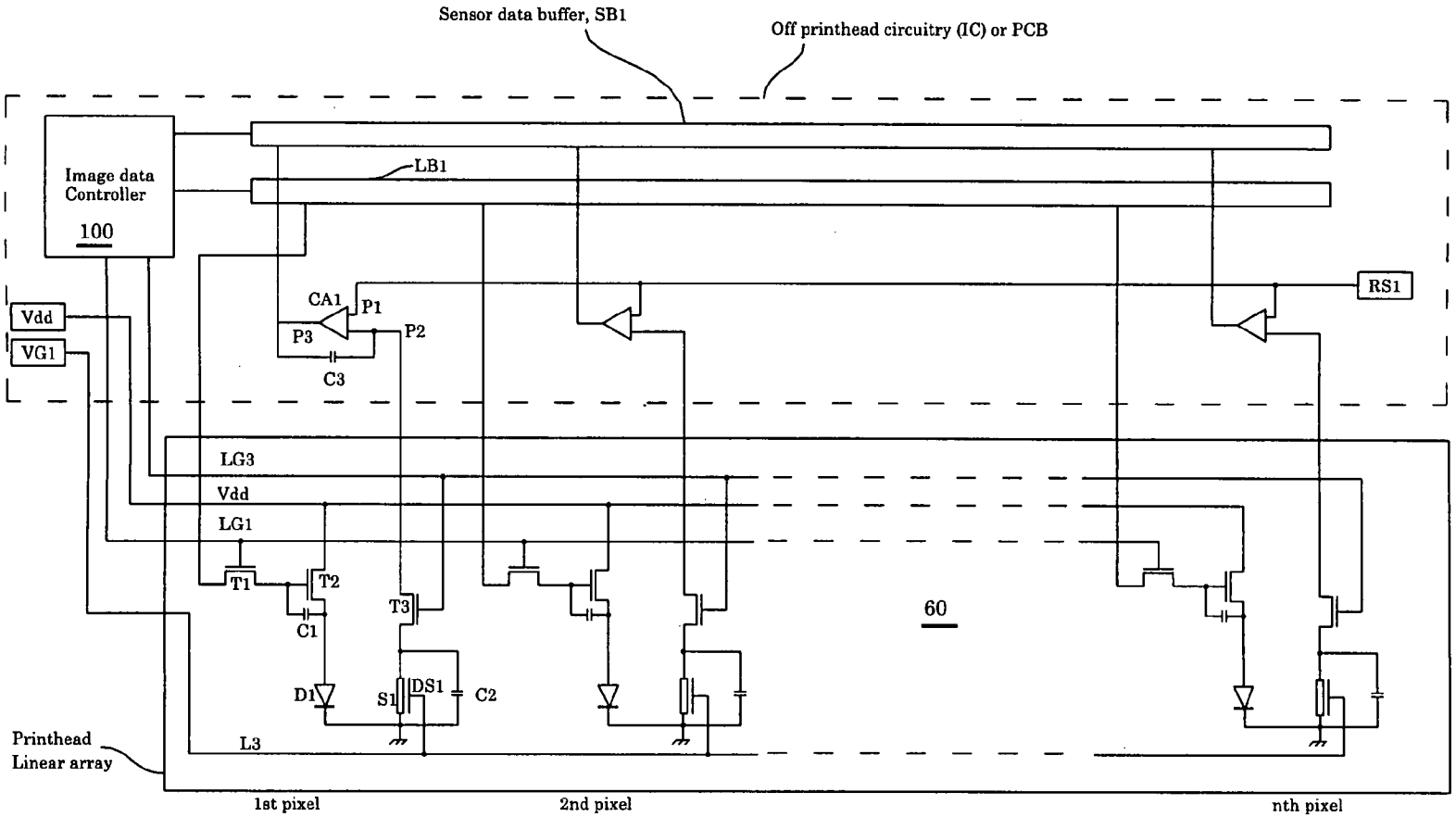
FIG. 12 illustrates an exemplary embodiment of a printhead implemented in an active matrix configuration having an open loop feedback control.

FIG. 12 shows an open loop feedback control embodiment of the present invention, in which the circuitry deposed onto the substrate 60 of the printhead 10 is contained in the solid line box designated at the Printhead Linear Array. The circuitry enclosed within the dashed line box of the printhead substrate 60 may be in the form of integrated circuits (ICs) or simply on a printed circuit board (PCBs). FIG. 12 illustrates an active matrix circuit, because the driving circuitry 80 of the light emitting elements 40 is embodied in TFTs T1 and T2, which are deposed on the same substrate 60 as the light emitting elements 40.

It is understood that FIG. 12 is exemplary and that circuit designers versed in the art will be able to construct various circuits that perform the functions of the invention. It is also understood that the term active matrix can refer to any additional circuitry deposed onto the printhead substrate. Therefore, all attendant circuitry including the line buffers can be deposed onto the printhead circuitry depending on the speed of the semiconductor materials. The active matrix configuration has been described above with reference to FIG. 10. The operations of the embodiments described with references to FIGS. 11 and 12 are identical. The advantage of open loop feedback systems is their better noise immunity and the amplification factor as explained above.

FIG. 13 shows the open loop configuration schematic where the linear array of light emitting 40 and sensing elements 30 are deposed on the printhead substrate 60. Also shown deposed also on the printhead substrate 60 are IC chips (integrated chips) 140 using the chip on glass (COG) technology. The COG technology is well known and in present use in the industry. The topology of a COG IC chip is shown in FIG. 14. The IC chips 140 include all the drive circuitry 80 including the line buffer LB1 and the sensor data buffer SB1. This configuration is the same as the active matrix circuitry having all the drive circuitry 80 including the buffers deposed in thin film on the substrate 60. But instead of the thin film technology, Chip On Glass (COG) technology is used. The preference of one embodiment over the other depends on speed and cost requirements. It is understood that the COG technology can be used with any of the embodiments described herein and with any amount of active matrix circuitry.

Figure 15:
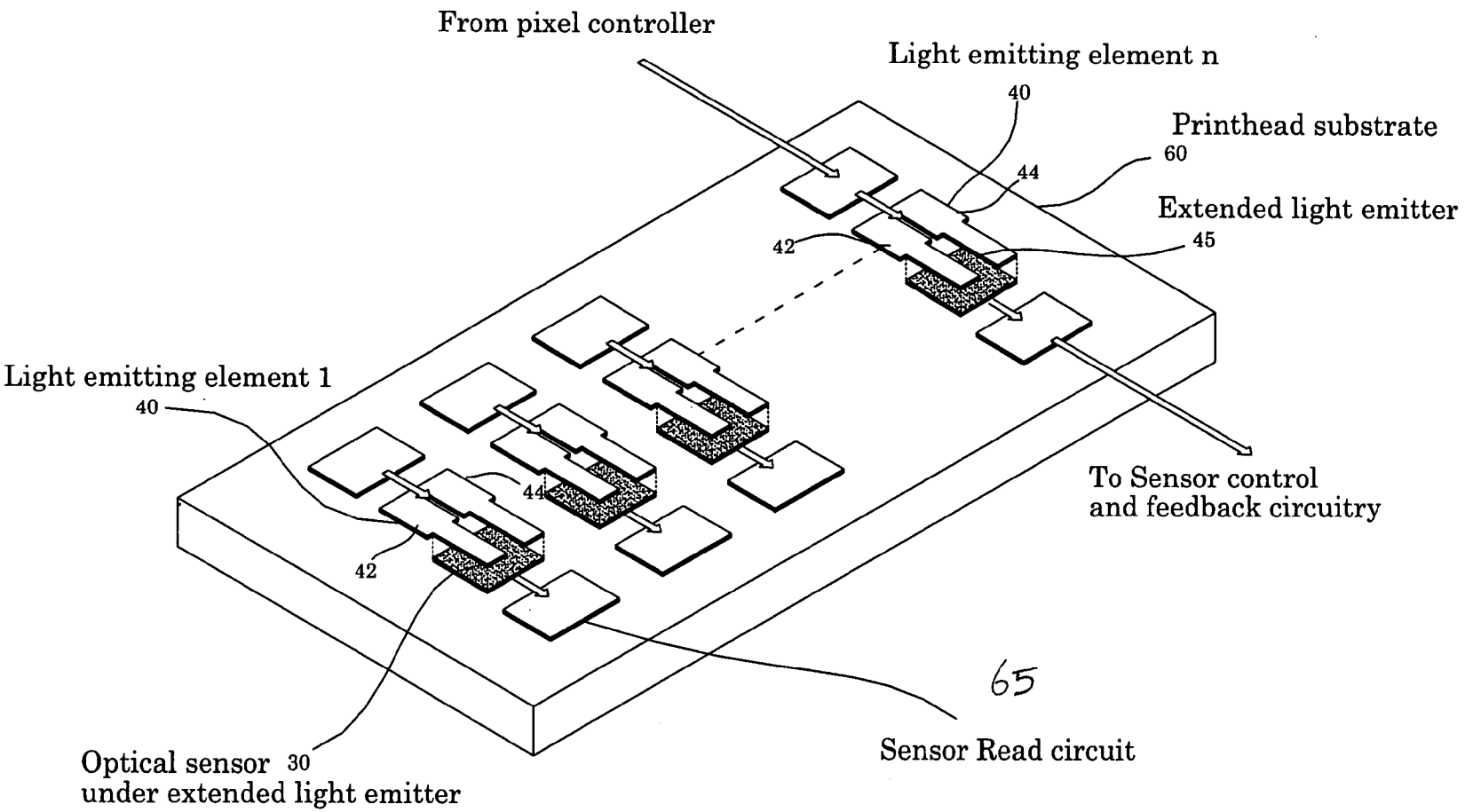
FIG. 15 illustrates an exemplary embodiment of a printhead in which an emissive pixel includes multiple light emitting elements.

The foregoing embodiments dealt only with solid pixels in a linear array. FIG. 15 shows the solid light emitting elements 40 sub-divided 42,44. Although each light-emitting element has been divided into two light emitters 42,44 the driving circuits 80 for both the light emitting elements 42,44 and the sensor read circuit 65 are not divided. That is one driver circuit 80 drives both the sub-pixels 42,44. One optical sensor 30 is used by both sub-light emitting elements 42,44.

The purpose of the sub-division is to provide redundancy. That is, light element D1 is used unless D1 is a failed light emitting element, in which case light element D2 is used. Alternatively, D1 and D2 can be used simultaneously to provide an extra gray level bit. For example, an 8-bit gray level system includes 256 levels of gray. To increase the top gray level to the next gray level, i.e. the $357^{th}$ level, an 8-bit system is inadequate and another bit is required. If the bit level is increased to 9 bits, greater power is used and the circuit complexity increases. The sub-divided light emitter elements 42,44 solves that problem by allowing D1 to be used for the first 256 levels of gray and only when D1 needs to be boosted to the $257^{th}$ level, D2 is turned on for the extra gray level. It is understood that the light-emitting element 40 can be divided into any number of sub-divisions to increase redundancy or gray levels. There can be three sub-divisions with each sub-division being a different primary color. Color mixing can be achieved by varying the time for which a sub-element 42,44 is on.

Figure 16:
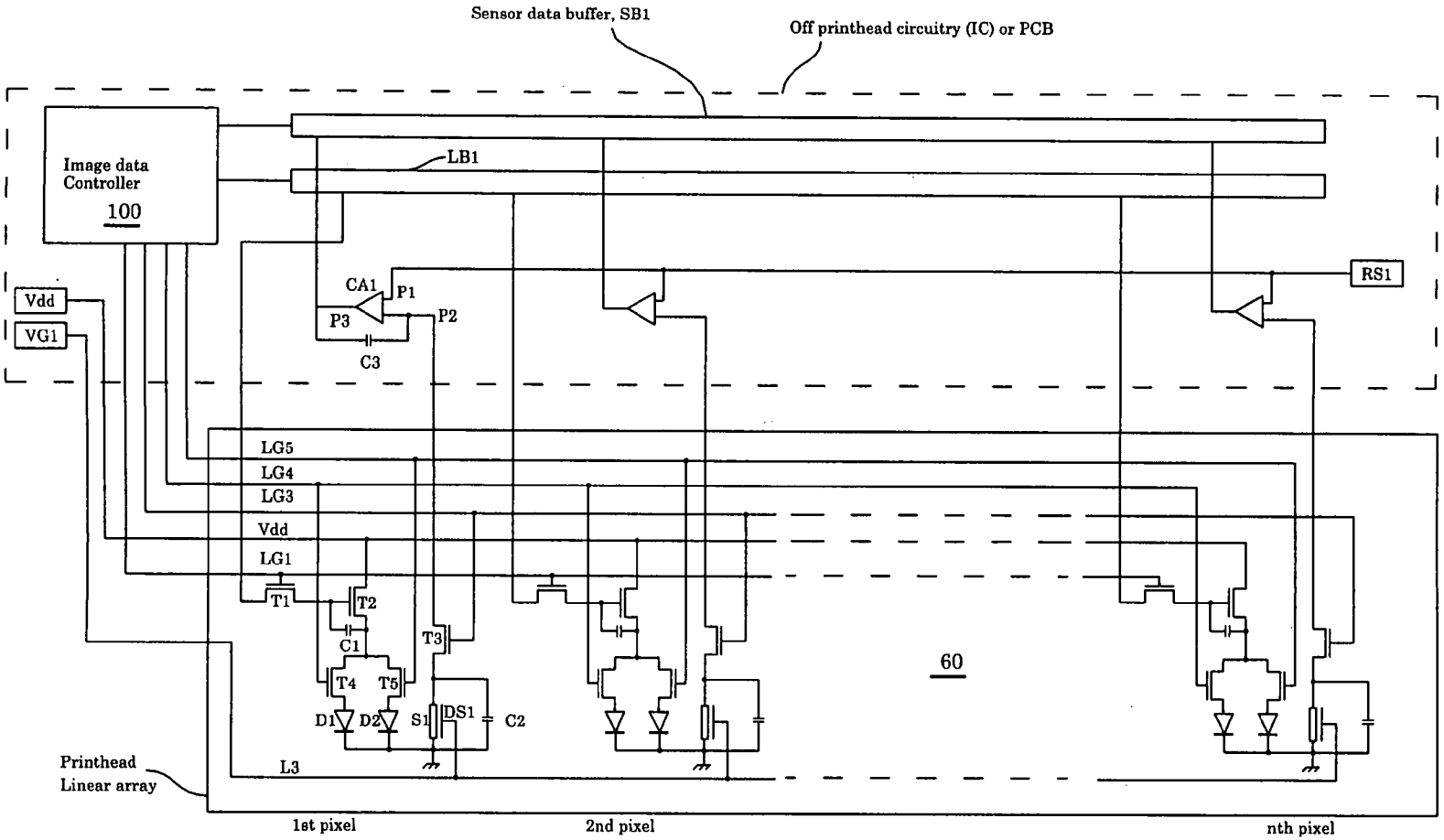
FIG. 16 illustrates an exemplary embodiment of a printhead implemented in an active matrix configuration having an open loop feedback control in which an emissive pixel includes multiple light emitting elements.

FIG. 16 shows an example of the circuit used to drive the sub-division system. Drive data is placed on the gate of TFTs T2 in the same manner as explained above and the sensor data is read in the same manner as above. TFTs T4 and T5 are used to independently control the sub-divisions through gate lines LG4 and LG5 by using the Image Data Controller 100. In the case of using sub-division for color mixing, the optical sensors 30 would also be sub-divided.

Figure 17:
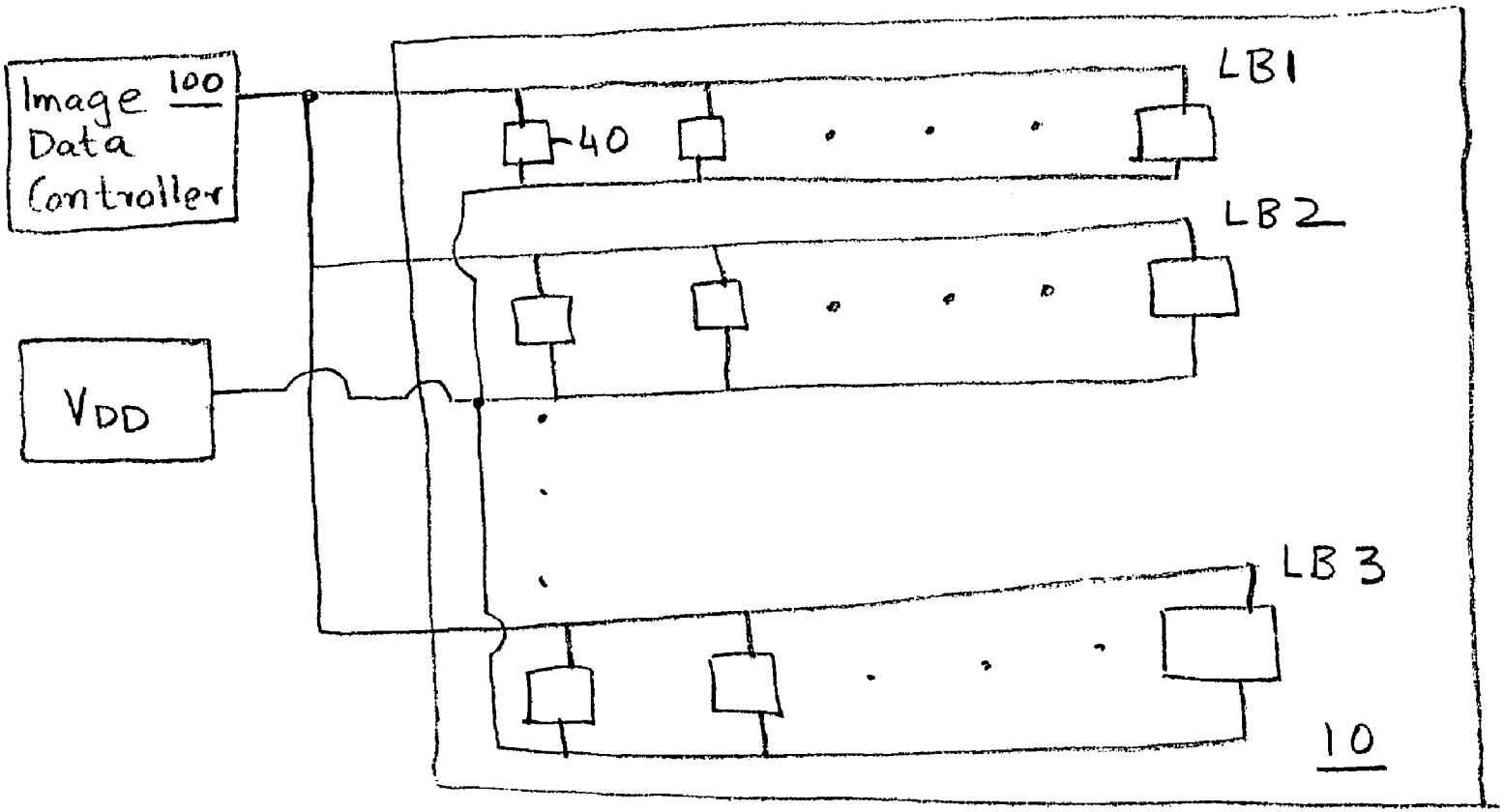
FIG. 17 illustrates an exemplary embodiment of a printhead having a page wide array of emissive pixels.

FIG. 17 shows a printhead 10 having a page wide array configuration of the emissive pixels. A plurality of emissive pixels 40 are shown arranged in rows and columns. Each row of the emissive pixels 40 is shown coupled to a line buffer LB1, LB2 . . . or LBN. The line buffers LB1, LB2 . . . and LBN are controlled by the Image Data Controller 100. Each row of the emissive pixels are also shown coupled to the voltage generator Vdd. The page wide array configuration can be implemented in both the active matrix and the passive matrix configurations. Also, the page wide array configuration can be implemented in both the interrupted loop and the open loop feedback systems. In one embodiment, the pixels 40 include organic light emitting diodes that are arranged according to the top-emitting configuration. In one embodiment, the pixels 40 include organic light emitting diodes that are arranged according to the bottom-emitting configuration.

In an application of the embodiment of FIG. 17, the paper 20 is positioned to receive emissions from the page wide array of pixels 40. The digital data for an image to be printed is loaded for all the pixels 40 by the Image Data Controller 100 through the line buffers LB1, LB2 . . . LBN. The line buffers LB1, LB2 . . . LBN may be loaded serially, i.e. one line buffer at a time. The line buffers LB1, LB2 . . . LBN may also be loaded in parallel, i.e. simultaneously. After all the line buffers LB1, LB2 . . . LBN are loaded with the digital image data, the voltage generator is turned on such that all the pixels 40 of the page wide array simultaneously emit light corresponding to the image data. In one embodiment, the paper 20 is momentarily held stationary when the voltage generator Vdd is turned on to simultaneously flash the pixels 40. In one embodiment, the paper 20 continues to travel when the voltage generator Vdd is turned on to simultaneously flash the pixels 40. In that embodiment, the speed of the paper travel must be slow enough and the flash time of the pixels 40 must be fast enough to allow the paper to properly receive and form the image.

Although preferred illustrative embodiments of the present invention are described above, it will be evident to one skilled in the art that various changes and modifications may be made without departing from the invention. The respective embodiments described above are concrete examples of the present invention; the present invention is not limited to these examples alone. The claims that follow are intended to cover all changes and modifications that fall within the true spirit and scope of the invention.

What is claimed is:

1. A method for controlling a light emitting element of an emissive pixel of an array of emissive pixels of a printhead of a printer comprising:

a first step of receiving an output of the light emitting element of the emissive pixel and generating a measurable parameter value for an output parameter;

a second step of repeating the first step for a plurality of times;

a third step of integrating the measurable parameter values generated in the first and second steps;

a fourth step of averaging the integrated value of the third step;

a fifth step of comparing the averaged value of the fourth step with a preset threshold value; and a sixth step of adjusting an input parameter of the light emitting element according to the result of the comparison in the fifth step;

wherein the output of the light emitting element can decline with the aging of the light emitting element; and wherein the preset threshold value is used to maintain an approximately constant output of the light emitting element.

2. The method of claim 1, wherein the measurable parameter value includes a voltage value.

3. The method of claim 1, wherein the output parameter includes the intensity of the output light.

4. The method of claim 1, wherein the second step includes repeating the first step for a plurality of times over a predetermined period of time.

5. The method of claim 1, wherein the second step includes repeating the first step for a predetermined number of times.

6. The method of claim 1, wherein the fourth step of averaging the integrated value of the third step includes dividing the integrated value of the third step by the number of times the measurable parameter value was generated in the first and second steps.

7. The method of claim 1, wherein the input parameter includes a voltage signal provided as an input to the light emitting element.

8. The method of claim 1, wherein the threshold value includes a voltage value representing the desirable measurable parameter value for the output parameter.

9. The method of claim 1, wherein the sixth step of adjusting includes increasing the voltage signal provided as an input to the light emitting element if the averaged value is below the threshold value and decreasing the voltage signal provided as an input to the light emitting element if the averaged value is above the threshold value.

10. A system for a printer comprising:

a printhead including an array of emissive pixels;

an emissive pixel of the array of emissive pixels including a light emitting element optically coupled to a sensing circuitry;

the sensing circuitry for receiving an output of the light emitting element and generating a measurable parameter value for an output parameter;

an integration circuitry for integrating the measurable parameter values for the output parameter for a plurality of the outputs of the light emitting element received by the sensing circuitry;

an averaging circuitry for averaging the integrated value;

a comparator for comparing the averaged value with a preset threshold value; and a controller for adjusting an input parameter of the light emitting element according to the result of the comparison;

wherein the output of the light emitting element can decline with the aging of the light emitting element; and wherein the preset threshold value is used to maintain an approximately constant output of the light emitting element.

11. The system of claim 10, wherein the light emitting element is fabricated from a material selected from the group consisting of an organic light emitting diode material, an electroluminescent material, an inorganic material, indium phosphide, and a combination thereof.

12. The system of claim 10, wherein the light emitting element is fabricated from an organic light emitting diode material selected from the group consisting of a small molecule fluorescent material, a small molecule phosphorescent material, a polymeric fluorescent material, a polymeric phosphorescent material, and a combination thereof.

13. The method of claim 10, wherein the measurable parameter value includes a voltage value.

14. The method of claim 10, wherein the output parameter includes the intensity of the output light.

15. The method of claim 10, wherein integration circuitry integrates over a predetermined period of time.

16. The method of claim 10, wherein the integration circuitry integrates the measurable parameter values for the output parameter for a predetermined number of outputs of the light emitting diode received by the sensing circuitry.

17. The method of claim 10, wherein the averaging circuitry divides the integrated value by the number of the measurable parameter values integrated by the integration circuitry.

18. The method of claim 10, wherein the input parameter includes a voltage signal provided as an input to the light emitting element.

19. The method of claim 10, wherein the threshold value includes a voltage value representing the desirable measurable parameter value for the output parameter.

20. The method of claim 10, wherein the controller increases the voltage signal provided as an input to the light emitting element if the averaged value is below the threshold value.

21. The method of claim 10, wherein the controller decreases the voltage signal provided as an input to the light emitting element if the averaged value is above the threshold value.

22. The system of claim 10, wherein the integration circuitry, the averaging circuitry, the controller and the comparator are situated in a semiconductor substrate in the printhead.

23. The system of claim 22, wherein the semiconductor substrate is fabricated from a material selected from the group consisting of amorphous silicon, poly-silicon, cadmium selenide, and a combination thereof.

24. The system of claim 10, wherein the sensing circuitry is fabricated from an optically sensitive material selected from the group consisting of amorphous silicon, poly-silicon, cadmium selenide, cadmium sulfide, tellurium sulfide, and a combination thereof.

25. The system of claim 10, further comprising:

an optical shield to shield a sensor of the sensing circuitry from an undesired optical noise.

26. The system of claim 10, further comprising:

the light emitting element includes a portion outside the emissive pixel area extended towards a sensor of the sensing circuitry for enhanced optical coupling.

27. The system of claim 10, wherein the array of emissive pixels includes a linear array of emissive pixels.

28. The system of claim 10, wherein the light emitting element is selected from the group consisting of an organic light emitting diode, and a light emitting diode.

29. The system of claim 10, wherein the controller and the sensing circuitry are fabricated at a same time in a same plane of a semiconductor substrate.

30. A system for a printer comprising:

a printhead including an array of emissive pixels;

an emissive pixel of the array of emissive pixels including a light emitting element;

means for receiving an output of the light emitting element and generating a measurable parameter value for an output parameter;

means for integrating the measurable parameter values for the output parameter for a plurality of the outputs of the light emitting element received by the sensing circuitry;

means for averaging the integrated value;

means for comparing the averaged value with a preset threshold value; and means for adjusting an input parameter of the light emitting element according to the result of the comparisons;

wherein the output of the light emitting element can decline with the aging of the light emitting element; and wherein the preset threshold value is used to maintain an approximately constant output of the light emitting element.

* * * * *